United States Patent [19]

Purssell

[11] Patent Number: 4,841,271

[45] Date of Patent: Jun. 20, 1989

[54] TRIP-FREE RESETTING MECHANISM FOR AN ON-OFF UNIT

[75] Inventor: Robert F. Purssell, Plymouth, England

[73] Assignee: Ranco Incorporated of Delaware, Dublin, Ohio

[21] Appl. No.: 2,161

[22] Filed: Jan. 12, 1987

[30] Foreign Application Priority Data

Jan. 17, 1986 [GB] United Kingdom ..... 8601115

[51] Int. Cl.[4] ..... H01H 37/38

[52] U.S. Cl. ..... 337/320; 200/83 Z; 337/130

[58] Field of Search ..... 337/118, 74, 130, 320, 337/321, 348, 367; 200/83 Z

[56] References Cited

U.S. PATENT DOCUMENTS

| | | | |
|---|---|---|---|
| 3,081,388 | 3/1963 | Cox | 337/348 |
| 3,781,744 | 12/1973 | Olson | 337/118 |
| 3,924,213 | 12/1975 | Semple | 337/130 |
| 4,039,991 | 8/1977 | Bucheister | 337/348 |
| 4,480,246 | 10/1984 | Schmitt | 337/348 |

*Primary Examiner*—H. Broome

*Attorney, Agent, or Firm*—Watts, Hoffmann, Fisher & Heinke

[57] ABSTRACT

A trip-free mechanism for resetting an on-off unit, such as a thermostat (1), breakable by the tripping of an actuator element (3) from a first condition to a second condition comprises a resetting button (9) engageable to apply a resetting force to the actuator element (3) to reset the latter in its first condition, and a restraining lever (10) acted upon by the resetting button (9) when it applies the resetting force to the actuator element (3) to maintain the unit in its broken condition until the button (9) is disengaged upon resetting of the actuator element.

5 Claims, 2 Drawing Sheets

TRIP-FREE RESETTING MECHANISM FOR AN ON-OFF UNIT

The present invention relates to trip-free mechanism for resetting on-off units of the type breakable by the tripping of an actuator element from a first condition to a second condition.

Such a mechanism is applicable particularly but not exclusively to an on-off unit constituted by a fail-safe remote sensing limit thermostat in which the actuator element comprises a flexible diaphragm supported by a housing and normally kept in an inwardly dished configuration relative to a closed chamber containing a fluid at sub-atmospheric pressure by the external atmospheric pressure, the fluid in the chamber expanding of vaporising at a predetermined limit temperature sensed by the thermostat so as to increase the pressure in the chamber and cause the diaphragm to snap into a stable outwardly dished configuration whereby the diaphragm opens, through a switch operating member, the normally closed contacts of an electrical switch having a fixed contact supported by the housing and a movable contact carried by a resiliently deflectable blade anchored relative to the housing, the blade normally biasing the movable contact into engagement with the fixed contact. Thermostats of this type are used to protect electrical equipment and appliances from operating at excessive temperatures.

The object of the present invention is to provide a trip-free mechanism for resetting on-off units of the aforesaid type, which ensures that the unit remains in its broken condition during resetting and thus ensures that the unit can be re-made only when safe conditions exist.

Accordingly, the present invention provides a trip-free mechanism for resetting an on-off unit breakable by the tripping of an actuator element from a first condition to a second condition, the mechanism comprising a resetting member engageable to apply a resetting force to the actuator element to reset the latter in its first condition, and restraining means acted upon by the resetting member when it applies the resetting force to the actuator element to maintain the unit in its broken condition until the resetting member is disengaged upon resetting of the actuator element.

In a preferred embodiment of the invention, for application to a thermostat of the sort described above, the resetting member comprises a push button which is pressed to apply a resetting force to the diaphragm through the switch operating member, and the restraining member comprises a transmission element which, upon pressing of the button, holds the switch contacts open until the diaphragm is reset and the button released, the contacts then being closed by the resilience of the blade. The push button may be operable manually or automatically.

Preferably, the transmission element comprises a cranked lever pivoted on the housing at its elbow and having one end acted upon by the push button and acting at its other end on the movable switch contact, the said one end of the lever and the push button having complementary ramp surfaces which cooperate upon pressing of the button to cause the lever to pivot into an orientation in which its other end holds the contacts open. When the button is released, the lever offers no resistance to the resilient return force of the blade.

Other embodiments may employ different transmission elements from the lever, for example a simple cam or gear system.

It will be appreciated that, in addition to its particular application to the thermostat defined above, the resetting mechanism can be applied equally well to other types of on-off units, such as valves, circuit-breakers, thermostats with bimetallic actuators, and the like.

A preferred embodiment of the invention will now be described, by way of example, with reference to the accompanying drawing in which.

Figure 1:
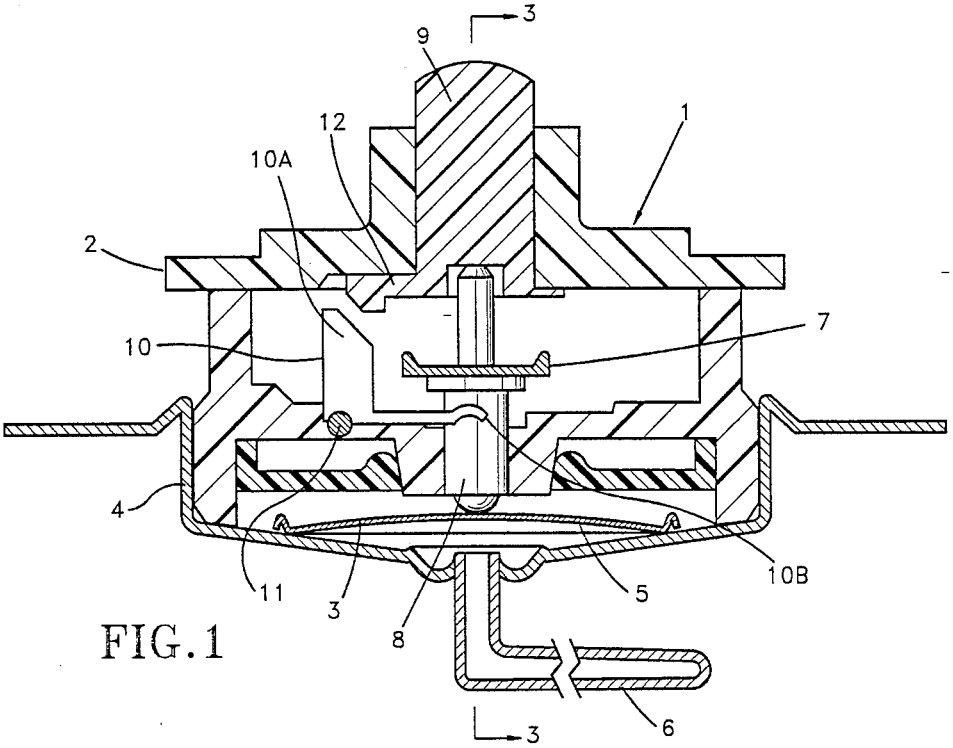
FIG. 1 is a diagrammatic sectional view of a fail-safe remote-sensing limit thermostat incorporating a trip-free resetting mechanism according to the invention, in a first operative condition.

In the drawings, there is shown a fail-safe remote-sensing limit thermostat 1 including a housing 2 and a resilient actuator diaphragm 3 hermetically sealed at its periphery to a casing 4 secured to the housing 2. The diaphragm 3 and the casing 4 define a closed chamber 5 containing a fluid which is normally at sub-atmospheric pressure but is selected to vaporise at a predetermined limit temperature sensed at a location of an electrical appliance controlled by the thermostat 1 by a capillary tube 6 extending from the casing 4.

Figure 3:
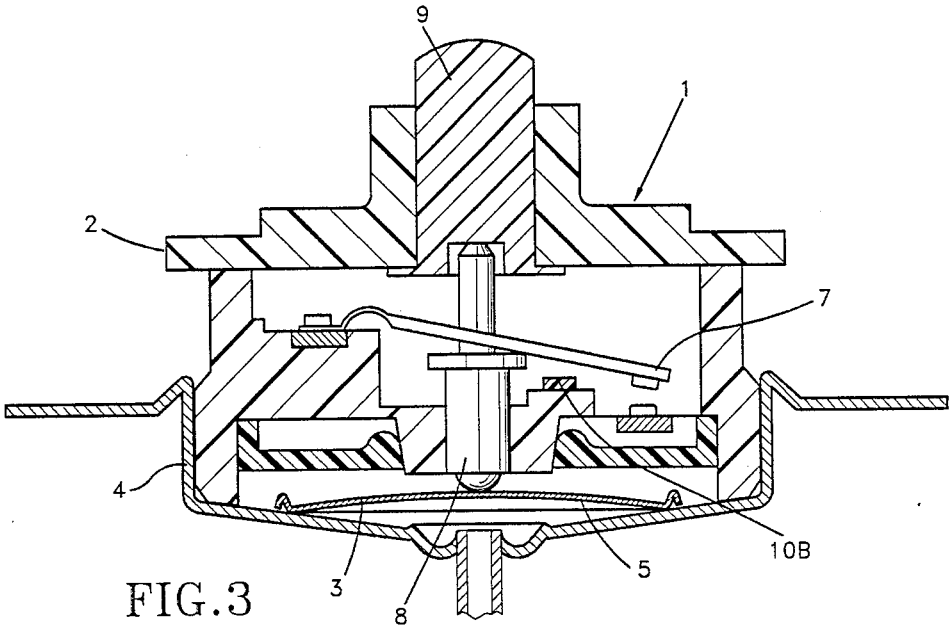
FIG. 3 is a cross sectional view seen approximately from the plane indicated by the line 3—3 of FIG. 1; and, FIG. 4 is a cross-sectional view seen approximately from the plane indicated by the line 4—4 of FIG. 2.

The thermostat 1 further includes an electrical switch comprising a fixed contact (FIGS. 3 and 4) supported by the housing 2 and connected to a respective terminal (FIGS. 3 and 4), a movable contact (not shown) carried by a resiliently deflectable blade 7 connected to a respective terminal (not shown) supported by the housing 2, and a switch operating member 8 between the diaphragm 3 and the blade 7.

When the thermostat 1 is in its normal state, that is the limit temperature has not been reached at the location monitored, the fluid pressure within the chamber 5 is below atmospheric pressure whereby the diaphragm 3 is kept in an inwardly-dished configuration relative to the chamber 5 (FIG. 2) and the contacts are closed by virtue of the resilience of the blade 7. If the limit temperature is reached at the location monitored (or if there is a leakage into the chamber 5 from the exterior), the fluid pressure in the chamber 5 increases until the pressure difference across the diaphragm 3 is small enough for the diaphragm 3 to trip, that is, to snap overcentre against the atmospheric pressure by virtue of its own resilience. When the diaphragm 3 trips (FIG. 1) the motion is transmitted by the member 8 to the blade 7 and the contacts are opened to switch off the appliance.

Before the appliance can be restarted it is necessary to close the contacts by resetting the diaphgram 3 in its inwardly dished configuration once the temperature has fallen below the limit temperature. For this purpose, the thermostat 1 is provided with a trip-free resetting mechanism according to the invention.

The resetting mechanism comprises a manually-operable reset button 9 which projects from the housing 2 and, when pressed, applies a resetting force to the diaphragm 3 through the member 8, and a cranked restraining lever 10 which is acted upon by the button 9 when it is pressed to hold the contacts open until the button 9 is released. the lever 10 is pivoted on the housing 2 at its elbow 11 and is acted upon at one end 10A by the button 9 and acts at its other end 10B on the blade 7. The end 10A of the lever 10 has a ramp surface complementary with a ramp surface formed on a lateral appendage 12 of the button 9.

Figure 2:
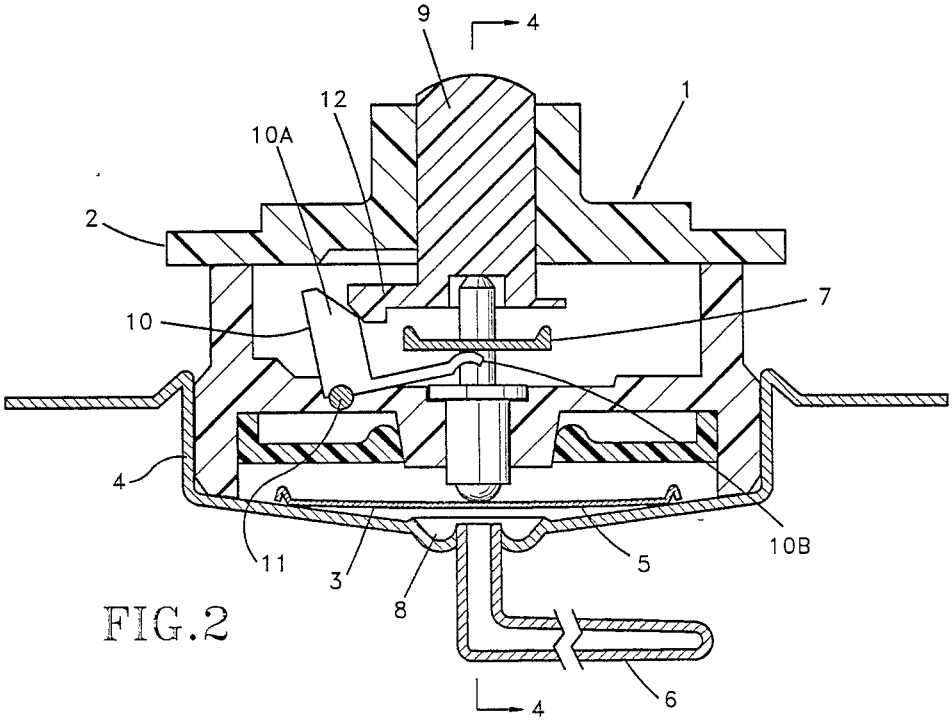
FIG. 2 is a view similar to FIG. 1, showing the mechanism in a second operative condition.
Figure 4:
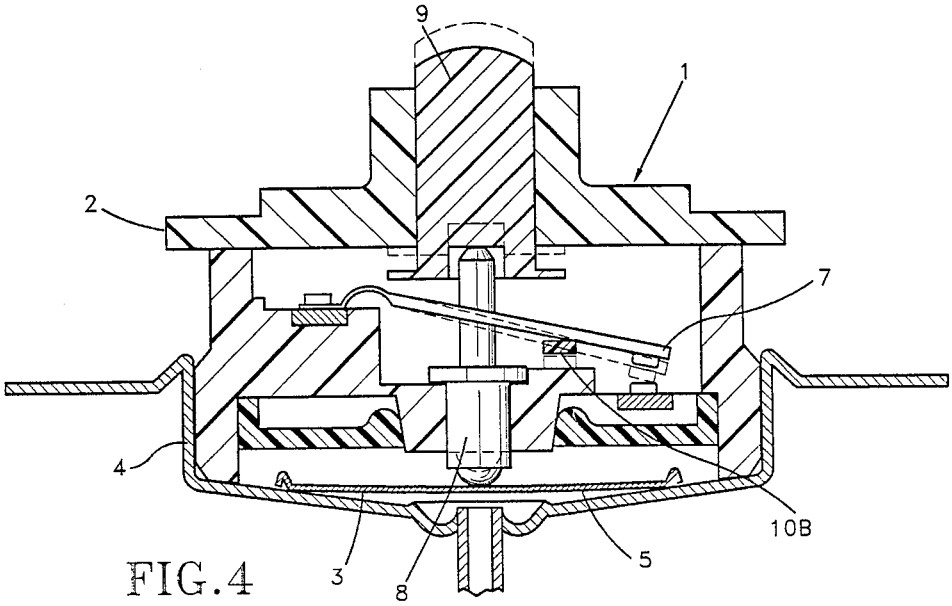

When the button 9 is pressed to reset the diaphragm 3, the ramp surfaces of the button 9 and the lever 10 cooperate to cause the lever 10 to pivot into an orientation, shown in FIGS. 2 and 4, where its end 10B maintains the resilient blade 7 in the contacts-open position to which it was carried by the switch operating member 8 upon tripping of the diaphragm 3. When the button 9 is released after the resetting of the diaphragm 3, the ramp surfaces disengage each other and the contacts are re-closed by the resilient deflection of the blade into its normal operating position (shown by broken lines in FIG. 4); the lever 10 offers no resistance to this deflection when it is free of the button 9.

The resetting mechanism is applicable equally well to single-pole single-throw (SPST) and single-pole double-throw (SPDT) versions of the thermostat.

The resetting mechanism of the invention as described above achieves "trip-freeness" by virtue of the fact that the contacts cannot close to re-start the appliance until the button 9 has been released after the resetting of the diaphragm 3: it is not possible to override the thermostat 1 by jamming the button 9 in. It depressed position, since this will only serve to keep the contacts open through the lever 10.

I claim:

1. A trip-free mechanism for resetting an on-off circuit breaking switch unit breakable by the tripping of an actuator element from a first condition to a second condition, the mechanism comprising a resetting member engageable and movable to apply a resetting force to the actuator element to reset the latter from its second condition to its first condition, and restraining means acted upon by the resetting member when said resetting member applies the resetting force to the actuator element, said restraining means having at least a portion moved in response to resetting movement of the resetting member to maintain the unit in its broken condition until the resetting member is disengaged upon resetting of the actuator element.

2. A trip-free mechanism for resetting an on-off unit constituted by a thermostat of the type having an actuator element comprised of a flexible diaphragm supported by a housing and normally kept in an inwardly dished configuration relative to a closed chamber containing a fluid at sub-atmospheric pressure by the external atmospheric pressure, the fluid in the chamber expanding or vaporizing at a predetermined limit temperature sensed by the thermostat so as to increase the pressure in the chamber and cause the diaphragm to snap into a stable outwardly dished configuration whereby the diaphragm opens, through a switch operating member, normally closed contacts of an electrical switch having a fixed contact supported by the housing and a movable contact carried by a resiliently defletable blade anchored relative to the housing, the blade normally biasing the movable contact into engagement with the fixed contact, further including a resetting member engageable to apply a resetting force to the diaphragm, the resetting member comprising a push button which is pressed and moved to apply a resetting force to the diaphragm through the switch operating member to reset the diaphragm in its inwardly dished configuration, and restraining means acted upon the resetting member when the resetting member moves to apply the resetting force to the diaphragm said restraining means maintaining the switch contacts open until the resetting member is disengaged upon resetting of the diaphragm, the restraining means comprising a transmission element which, upon pressing movement of the button, is forcibly shifted to a restrainng position where it engages the switch and holds the switch contacts open until the diaphragm is reset and the button is released, the contacts then being closed by the resilience of the blade which also returns the transmission element from its restraining position.

3. A trip-free resetting mechanism according to claim 2, wherein the transmission element comprising a cranked lever pivoted on the housing at its elbow and having one end acted upon by the push button and acting at its other end on the movable switch contact, the said one end of the lever and the push button having complementary ramp surfaces which cooperate upon pressing of the button to cause the lever to pivot into an orientation in which its other end holds the contacts open, the lever offering no resistance to the resilient return force of the blade when the button is released.

4. A trip-free resetting mechanism according to claim 2 or claim 3, wherein the push button is operable manually.

5. A trip-free mechanism according to claim 1 wherein the unit further comprises an electrical switch having a stationary contact and a movable contact supported by a resilient blade for biasing said movable contact toward engagement with said stationary contacts, said restraining means comprising a cranked lever pivoted at its elbow and having one end acted upon by the resetting member and acting at its other end on the movable switch contact, the said one end of the lever and the resetting member having complementary ramp surfaces which cooperate upon resetting engagement of the resetting member to cause the lever to pivot into an orientation in which its other end holds the movable switch contact away from the stationary contact, the lever offering no resistance to the resilient return force of the blade when the resetting member is released.

* * * * *